US012185804B2

(12) United States Patent
McHeffey

(10) Patent No.: US 12,185,804 B2
(45) Date of Patent: Jan. 7, 2025

(54) IMPETUS POLE

(71) Applicant: William F McHeffey, Rumson, NJ (US)

(72) Inventor: William F McHeffey, Rumson, NJ (US)

( * ) Notice: Subject to any disclaimer, the term of this patent is extended or adjusted under 35 U.S.C. 154(b) by 140 days.

(21) Appl. No.: 18/166,616

(22) Filed: Feb. 9, 2023

(65) Prior Publication Data

US 2024/0268529 A1 Aug. 15, 2024

(51) Int. Cl.
*A45B 9/02* (2006.01)
*A45B 9/00* (2006.01)

(52) U.S. Cl.
CPC ..... *A45B 9/02* (2013.01); *A45B 2009/005* (2013.01); *A45B 2200/05* (2013.01)

(58) Field of Classification Search
CPC .. A45B 9/02; A45B 2009/005; A45B 2200/05
See application file for complete search history.

(56) References Cited

U.S. PATENT DOCUMENTS 788,541 A * 5/1905 Kunkel ..... A61H 3/0288 135/65
1,909,337 A * 5/1933 Crosbie ..... A61H 3/02 135/83
2,397,499 A * 4/1946 McGowan ..... A61H 3/0277 135/82
4,362,322 A * 12/1982 Schwarz ..... A63C 11/221 135/65
5,295,715 A * 3/1994 Van Blaricom ..... A63C 11/222 267/74
5,484,361 A * 1/1996 Dunn ..... A63B 21/05 482/109
6,131,592 A * 10/2000 Panizza ..... A45B 9/00 403/220
6,254,134 B1 * 7/2001 Panizza ..... A63C 11/22 280/821
8,166,989 B2 * 5/2012 Heim ..... A63C 11/24 135/81
8,276,943 B2 * 10/2012 Best ..... F16F 15/022 135/65
8,528,577 B2 * 9/2013 Pietrzak ..... A45B 9/02 135/86
10,898,406 B2 * 1/2021 McAteer ..... A61H 3/068
11,071,362 B2 * 7/2021 Lai ..... A45B 9/04
11,698,168 B2 * 7/2023 Ballentine ..... F16M 11/041 135/66

* cited by examiner

*Primary Examiner* — Noah Chandler Hawk

(57) ABSTRACT

An apparatus that imparts a propelling force upon a body when stepping forward during walking motion is comprised of and assembled concentrically together with a stick, pin, elastic tube, coupler, and hand held grip. The user rotates the apparatus in a forward circular motion towards the same direction of travel about a fixed location at the stick bottom on the ground surface. An impulse occurs from the apparatus upon the ground surface that is caused by the arm and upper body muscular contractions working against the elongation of the elastic tube. Then the coupler that is attached to the recoiling elastic tube attains a momentum that equals the combined masses of the coupler and grasped hand multiplied by the resultant of the tangential and radial velocity vectors. Both resultant impulse and momentum vectors are combined with the user's forward momentum because the user holds onto the grip of the device.

1 Claim, 9 Drawing Sheets

IMPETUS POLE

CROSS REFERENCE TO RELATED APPLICATIONS

The following non-provisional utility patent application claims the benefit of the prior filed provisional patent application U.S. 63/372,135 filing date 02/18/2022, Impetus Pole.

BACKGROUND OF THE INVENTION

The Impetus Pole is correlated with the field of endeavor of Canes, Sticks, Crutches and Walking Aids (USPC 135/65) and is drawn towards those devices that incorporate springs or other flexural members to improve their function. There exists several examples of such implements, with the prior art patents noted from the beginning of last century and continuing to the more recent prior art patents that are described herein.

Kunkle, U.S. Pat. No. 788,541 dated May 2, 1905, illustrates a Cane or Crutch Attachment that generally consists of an internal steel spring within the cane or crutch body to, " . . . relieve the user from jars or concussions incident to the act of walking or otherwise moving from place to place." (lines 14-16) This design allows the cane or crutch user to work against the gradually increasing spring force during compression as the user exerts their weight upon it. In turn, the spring works against the user as the spring gradually recoils to the relaxed position as the user reduces their weight upon it. The transformation and conservation of energy from kinetic to potential and back to kinetic energy as from the work done by a spring or other flexural member has been established by the science of elementary physics. Subsequent prior arts also utilize energy transformation and conservation theory in their own designs in a similar but improved manner to the original prior art by Kunkle to dampen the reactionary ground forces upon elongated poles used by walkers.

McGowen, U.S. Pat. No. 2,397,499 dated Apr. 2, 1946, illustrates a Crutch Tip Construction. This spring mechanism is located in the bottom portion of the crutch on the end in contact with the ground. Upon weight from the user this tip is allowed to flex in a downward and upward fashion. Heim, U.S. Pat. No. 8,166,989 B2, dated May 1, 2012, Nordic Walking Pole with Rubber Buffer, positions a rubber buffer in a bottom tip rotating mechanism. Best et al., U.S. Pat. No. 8,276,943 B2, dated Oct. 2, 2012, Systems and Methods for Pole Impact Force Damping, utilizes a compression elastomer material in the handle. Rudin, U.S. Pat. No. 9,763,502 B2, Dated Sep. 19, 2017, Walking Stick with S-Shaped Flexure Mechanism to Store and Release Energy, comprises a type of curve shaped spring of composite material that flexes in the manner of a leaf spring. These prior arts are limited solely to provide a dampening effect against the forces exerted by the user and by the equal and opposite ground surface reactions.

Canes, Sticks, Crutches and Walking Aids are utilized for human ambulatory propulsion by transferring upper body and arm muscular strength to the ground to push one forward. An individual using such walking aids would benefit greatly from a new device that would increase the reaction of an exerted force to move one forward. The Impetus Pole provides that additional propelling force not found in the prior arts, utilizes the Laws of Motion of elementary physics in the functional design, and increases the force upon the individual in forward motion.

SUMMARY OF THE INVENTION

The Impetus Pole is comprised with a spring mechanism that does not limit this invention's use to dampening purposes only. The prior art functions by that particular spring mechanism being compressed as the user exerts their weight in a downward and backwards direction with respect to the user's forward motion direction. Instead, the Impetus Pole is rotated forward about the distal end's point of contact with the ground. While the user's hand that is holding the invention is extended ahead, a centripetal acceleration of the circular rotation directs the user's upper body muscular contraction to elongate the spring mechanism in a radial direction, causing an impulse force from the device upon the ground. As the user begins to step forward with the rear foot pushing against the ground surface, a resultant velocity vector manifests a momentum of a hand-grasped movable component connected to the spring mechanism. This momentum is transferred to the user because the user's hand is grasping this movable component with the developed momentum. Since the fully extended arm is attached to the hand grasping the device, the transferred impulse and momentum boosts the user's momentum, because both the impulse from the ground reaction and the momentum of the movable component are in the same direction as the user's forward walking motion direction. The dampening feature of the prior art's spring mechanism concerns only the energy transfer and conservation with regards to the work done by a spring upon a body. The Impetus Pole, with the incorporated spring mechanism and hand-held movable mass, concerns the change in the momentum of a body when both an external impulse and momentum are applied to that body, since both impulse and momentum have the same units of force×time. Anyone that desires a device that propels one forward with an increase in their forward momentum would benefit by using the Impetus Pole.

DESCRIPTION OF THE DRAWINGS

Nine (9) drawing sheets are provided to clarify the invention and method of use.

11. Stick
12. Pin
13. Elastic Tube
14. Coupler
15. Grip

The Impetus Pole components are concentrically positioned around the outside of the Stick that extends from the Ground up through the middle of the Coupler and Elastic Tube to the Pin. The bottom of the Pin is affixed to the top of the Stick. The Elastic Tube is positioned over and affixed to the Pin, and the Elastic Tube is positioned over and affixed to the top portion of the Coupler at the Grip. The Coupler is free to translate along the outside of the Stick. The Elastic Tube is free to elongate and recoil along the outside of the Stick because the upper end of the Elastic Tube is fixed to the Stick at the Pin, and because the lower end of the Elastic Tube is fixed over the Coupler at the Grip. The Stick is a slender round solid member, the Pin is a thistle-shaped solid member, the Elastic Tube is a stretchable rubber tube member, and the Coupler is a hollow walled member. The Coupler inside diameter is greater that the outside diameter of the Stick so that the Coupler is able to translate along the stick. The Grip is a non-slip tape material affixed over the Elastic Tube at the Coupler for the user to grasp the device with the hand.

Figure 1:
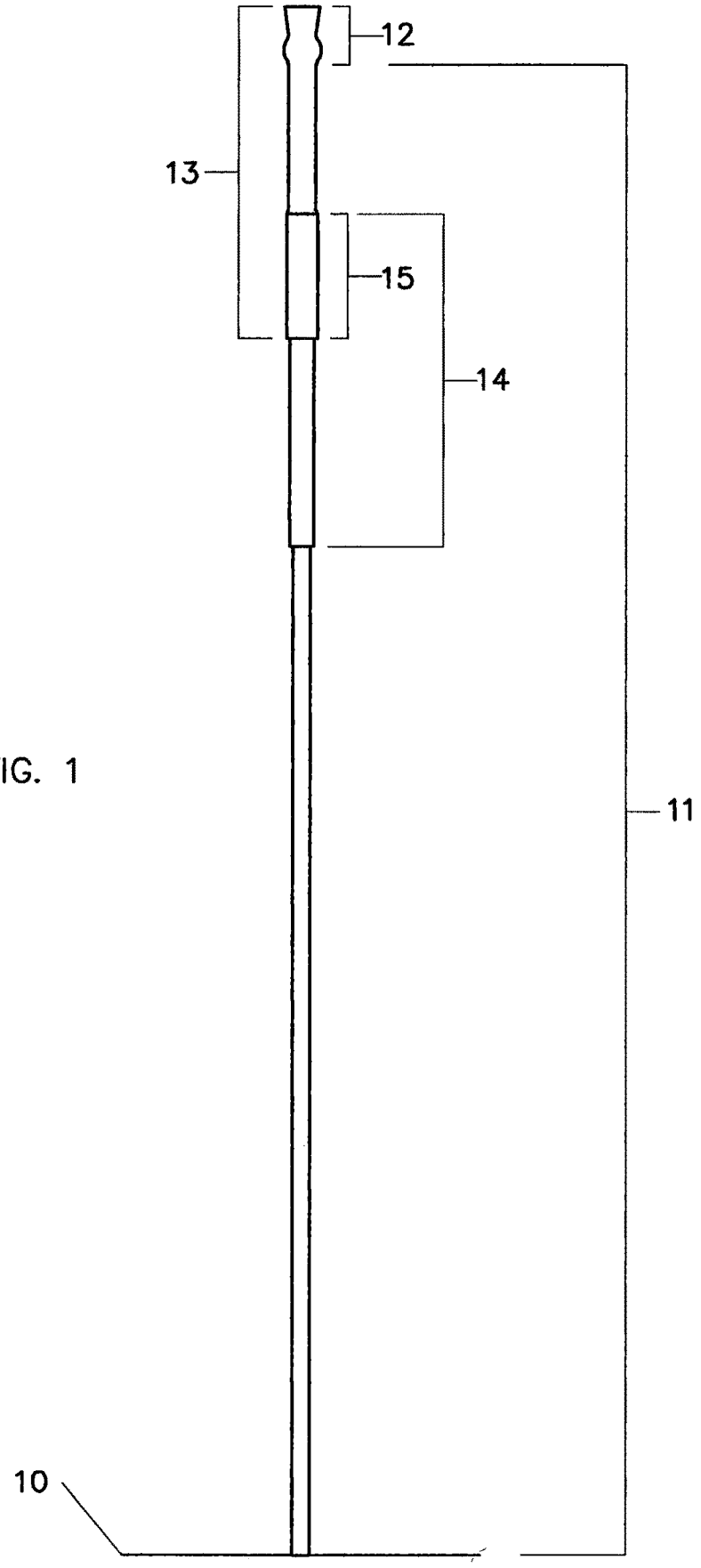
FIG. 1 shows the side elevation of the Impetus Pole where the top of the page is the upper end of the device that is free to rotate about the lower end of the device in contact with the Ground, 10. The components of the Impetus Pole.
Figure 2:
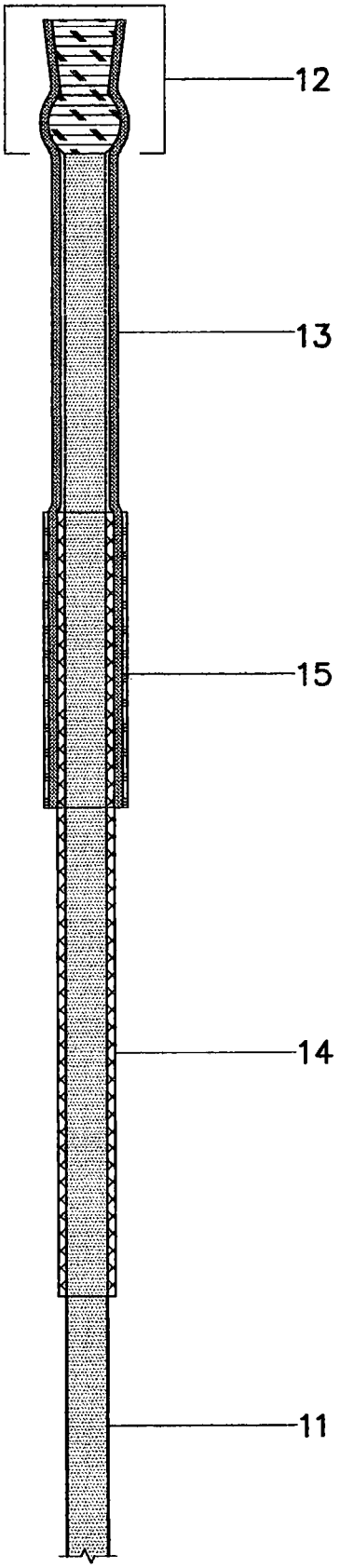

FIG. 2 depicts a cross sectional view of a vertical plane through the centerline of the device. The Stick lower end is omitted below the break line. The different hatching of each component illustrates the cocentric orientation of the components, beginning with the Stick 11, with the top of the Stick connected to the Pin 12, over which the top of the Elastic Tube 13 is affixed to. The bottom of the Elastic Tube is affixed over the upper portion of the Coupler 14. Clear space separates the Stick and Elastic Tube between the Pin and Coupler. The Grip 15 is positioned where the Elastic Tube overlaps the Coupler.

Figure 3:
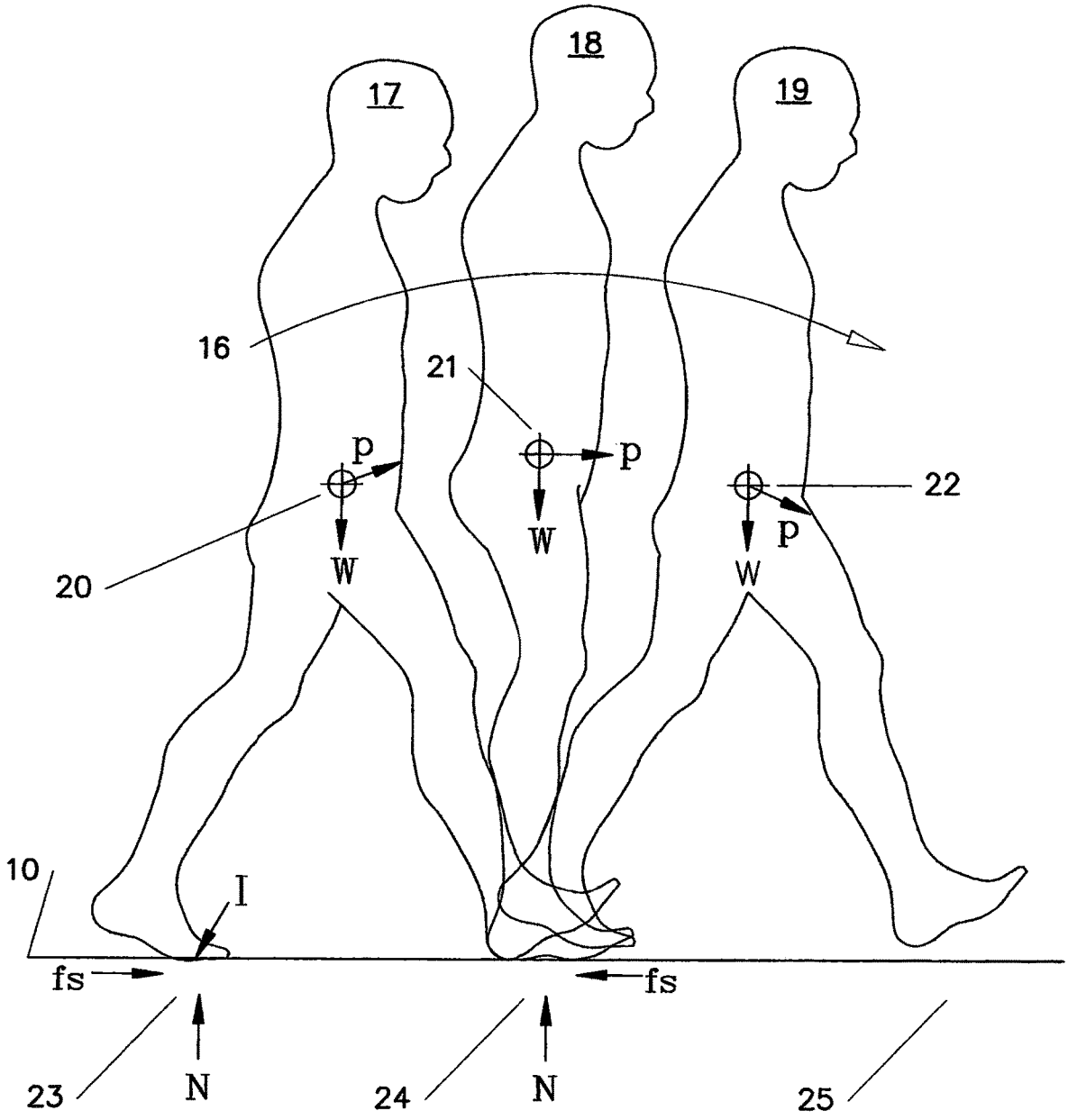

FIG. 3 illustrates the dynamics of a step during forward walking motion. The open arrow lead line at 16 denotes the direction of motion from left to right in the vertical plane parallel to FIG. 3. Closed arrows denote force, impulse and momentum vectors during walking motion. The person moves through positions 17, 18, and 19, while the person's center of gravity moves through 20, 21 and 22, where the weight W is directed downward and the momentum p moves along a curved path parallel to 16. The person at location 17 pushes off with the back foot at 23, with an impulse I against the ground 10. The ground reacts against the impulse with a normal force N and static friction force fs. The person rotates forward about the front foot at 24 with the ground reacting with normal and static friction forces until the person's back foot moves past the position at 24 and then contacts the ground at 25. This step is repeated again with the opposite foot to complete a stride as the person continues to walk forward. In order for the person to attain a particular momentum p, that is, the person's mass multiplied by the person's velocity, the person must push with the leg and foot with an impulse I, that is, a force multiplied by the time duration, of which that impulse equals the momentum p. The person's velocity and momentum are directly proportional to the impulse the person causes against the ground.

Figure 4:
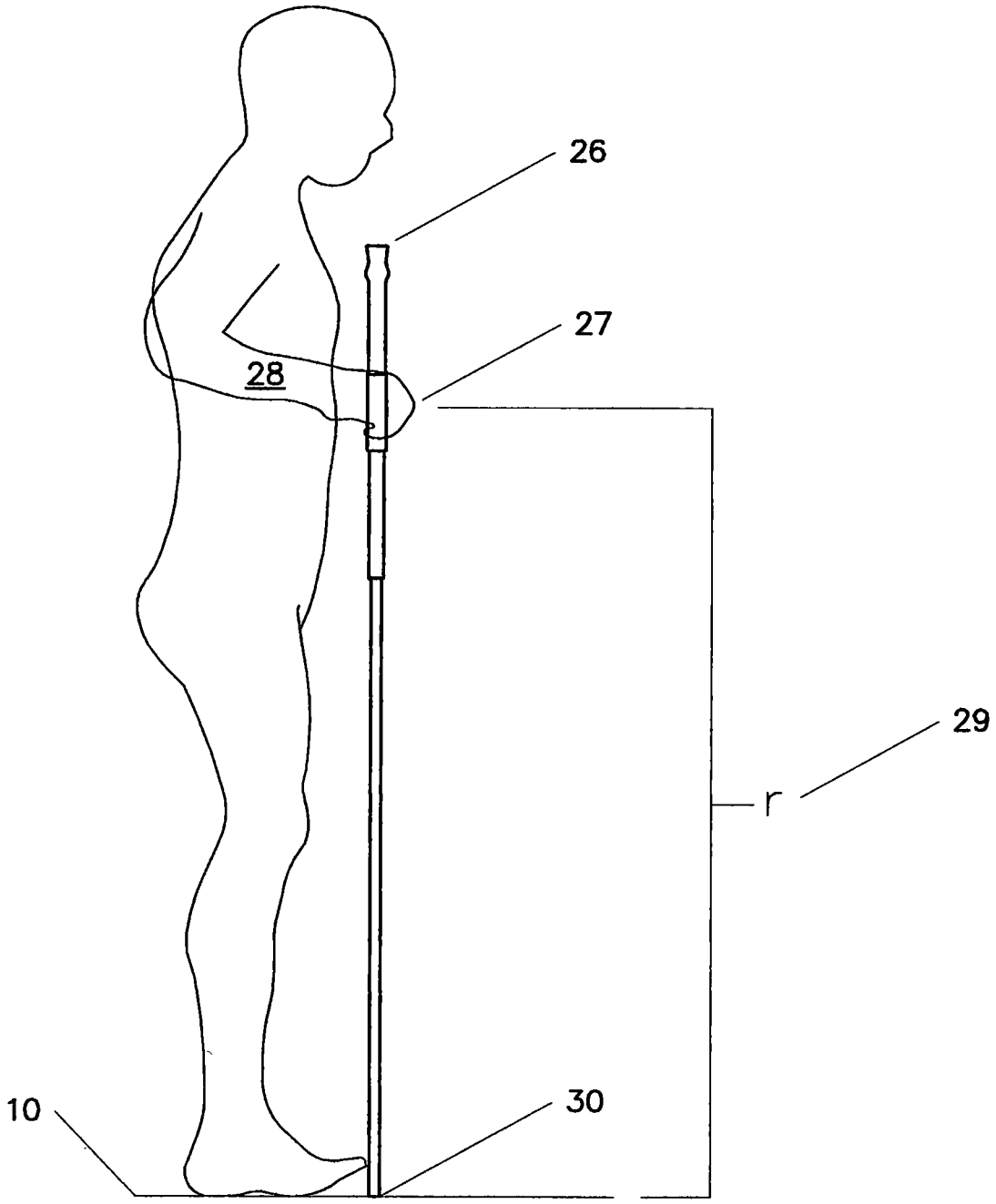
Figure 5:
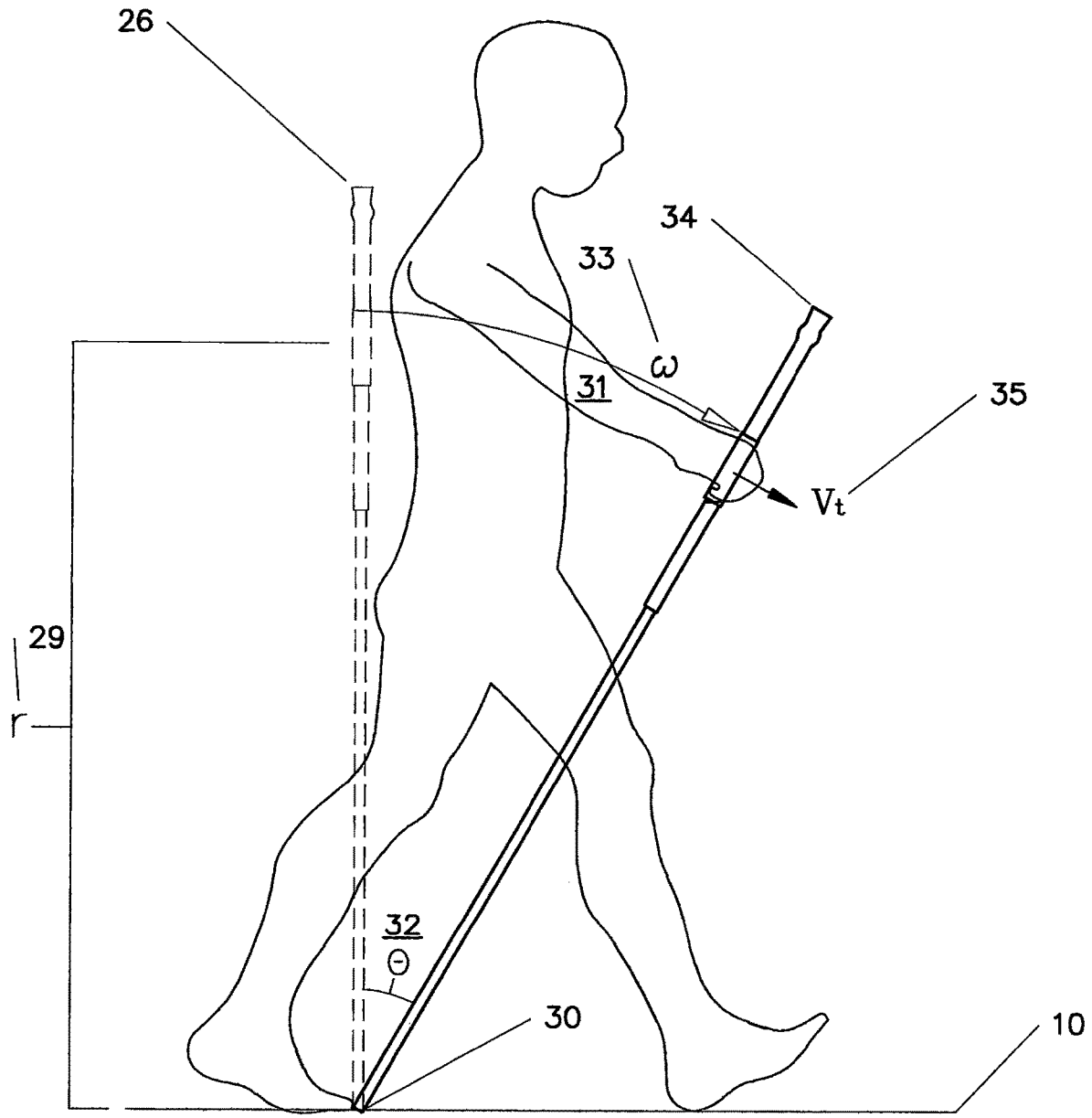
Figure 6:
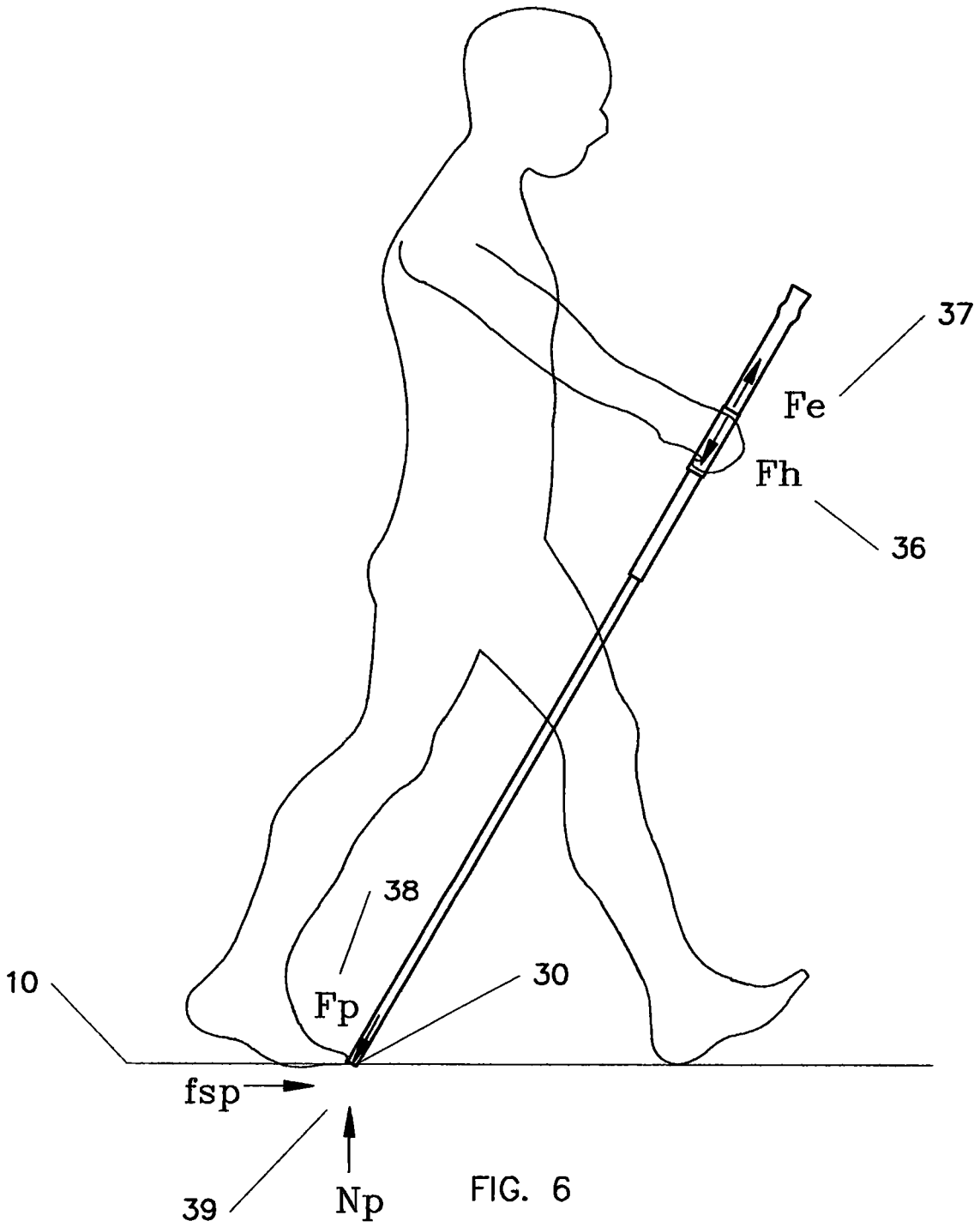
Figure 7:
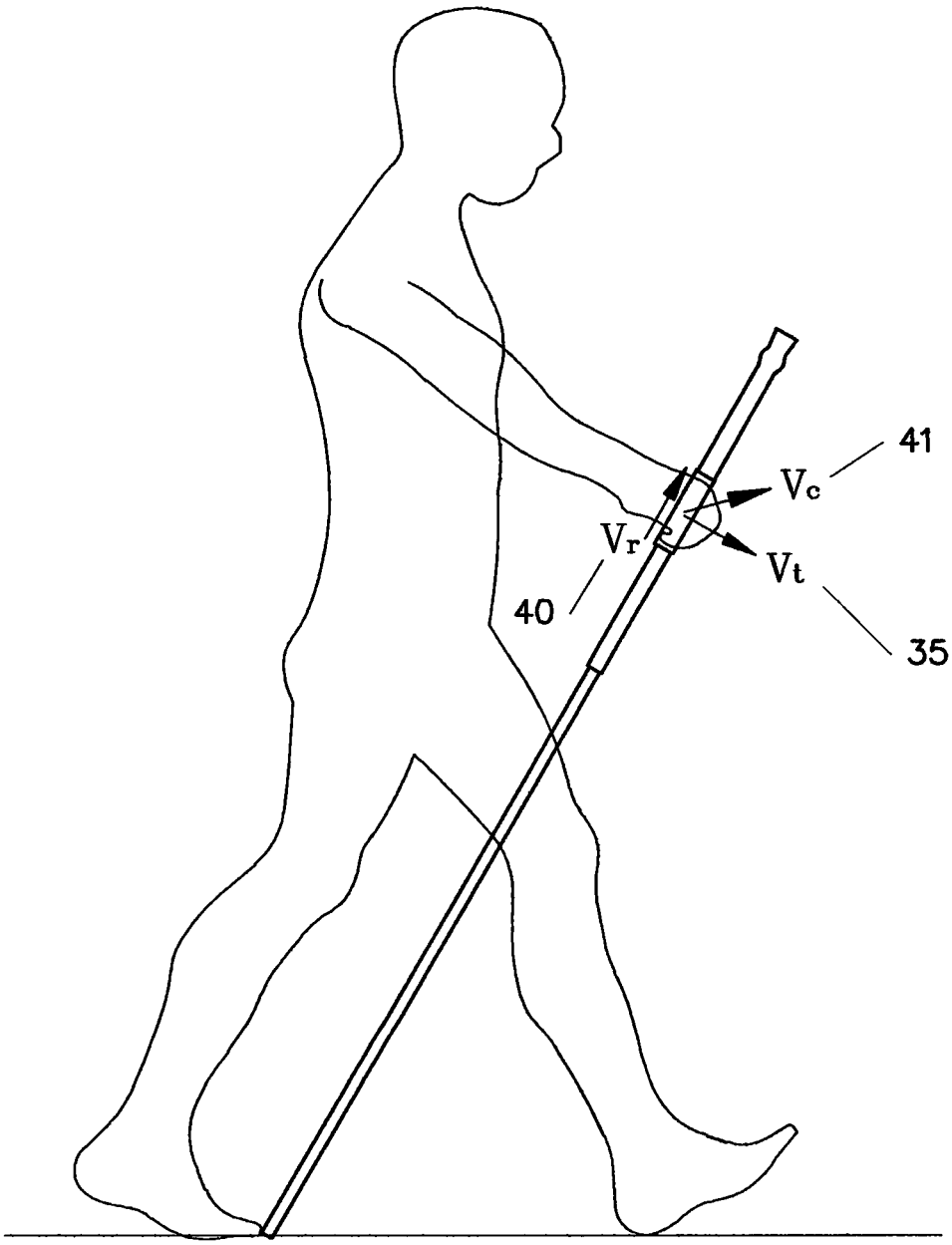

FIG. 4, FIG. 5, FIG. 6, and FIG. 7 illustrate the method of use initial sequences, beginning with the person standing and holding the Impetus Pole vertically at 26 as shown on FIG. 4. The person holds the device with the hand at the Grip at 27. The person's arm 28 is held with the forearm at an approximate right angle to the upper arm. The height r at 29 is measured vertically from the hand at the Grip at 27 to the bottom of the device at 30 on the ground 10. FIG. 5 shows the person stepping forward from 26, extending the arm forward at 31, of an angular displacement theta, Θ, at 32, with the angular speed omega, w, shown by the open arrow at 33. With the Impetus Pole approaching the position at 34, having been rotated about the fixed ground point at 30, the tangential velocity vector Vt at the Grip shown at 35, has a magnitude equal to the product of $r\times\Theta\times\omega$, and is being directed tangentially to the circular motion of the rotating Impetus Pole, as shown by the closed arrow at 35. FIG. 6 illustrates that while rotating the Impetus Pole forward, the upper body muscles flex simultaneously, causing the grasped hand to slide the Grip and Coupler downwardly along the Stick with a force Fh, as shown at 36. An equal and opposite elastic force Fe occurs within the stretched Elastic Tube, as denoted at 37. The Pin affixed to the Stick causes an equal and opposite force Fp, as denoted at 38, which force is located on the ground at 30. As indicated at 39, the ground reacts against Fp with normal and static friction forces, Np and fsp, respectively. All of the forces described on FIG. 6 are directly proportional to the magnitude of the upper body muscle flexure imposed by the person holding onto the Grip. FIG. 7 illustrates the subsequent inflection point where the Elastic Tube recoils and moves the Coupler with a velocity vector Vr as denoted at 40. Both the tangential and recoil velocity vectors, as shown at 35 and 40, respectively, are combined to equal the resultant velocity vector Vc of the Coupler, as depicted at 41.

Figure 8:
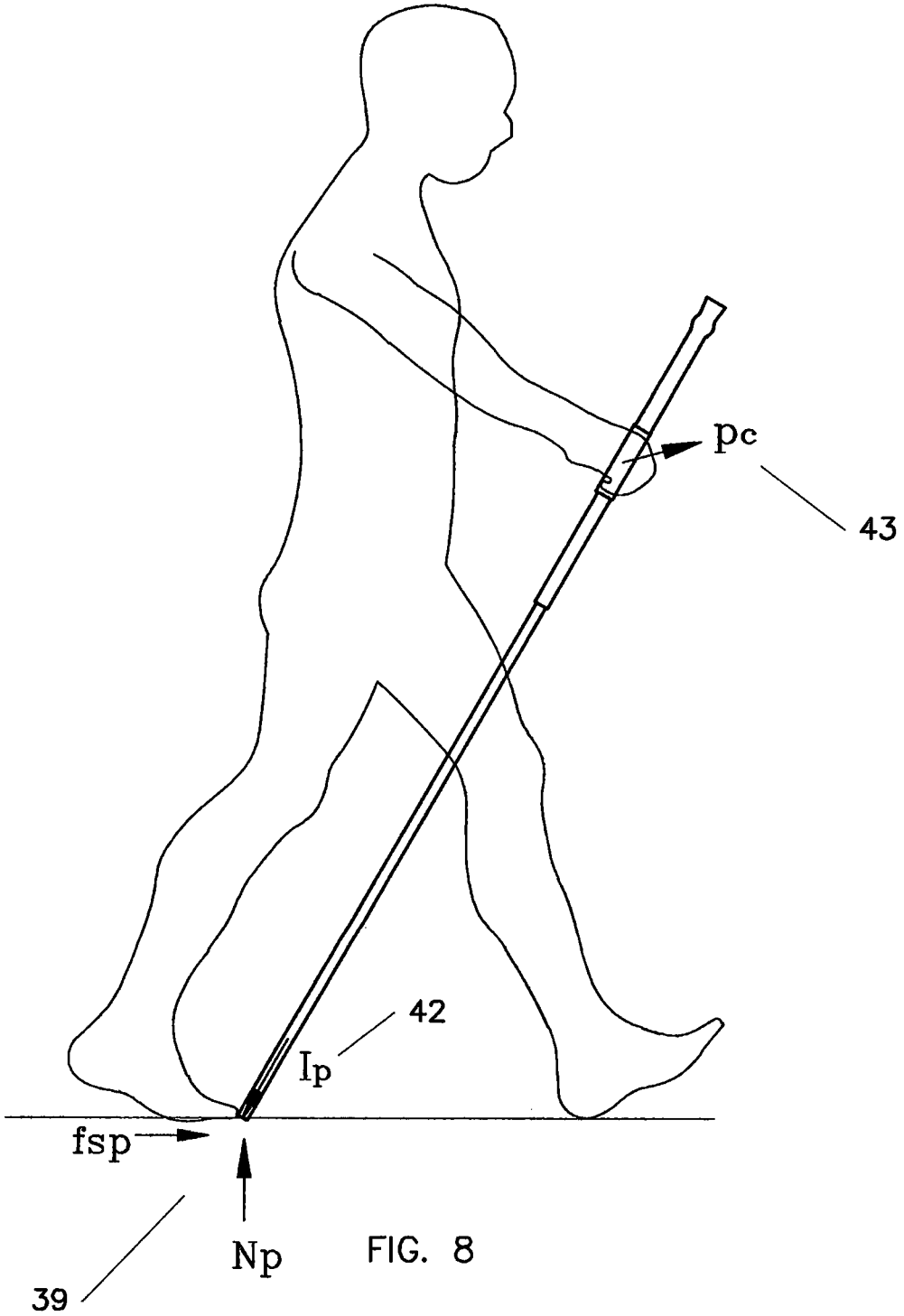

FIG. 8 shows the person pushing off with the back foot against the ground. The ground reacts during rotation with normal and static friction forces at 39 against the impulse vector Ip at 42. The impulse magnitude is the average force vector Fp, as shown on FIG. 9, multiplied by the rotation time. As described previously and as shown on FIG. 7, the resultant velocity vector of the Coupler Vc at 41, occurs because the Impetus Pole is rotating while the Elastic Tube is recoiling. On FIG. 8 a resultant momentum vector of the Coupler pc is depicted at 43, since the momentum vector of the Coupler equals the combined masses of the Coupler and grasped hand multiplied by the resultant velocity vector of the Coupler.

Figure 9:
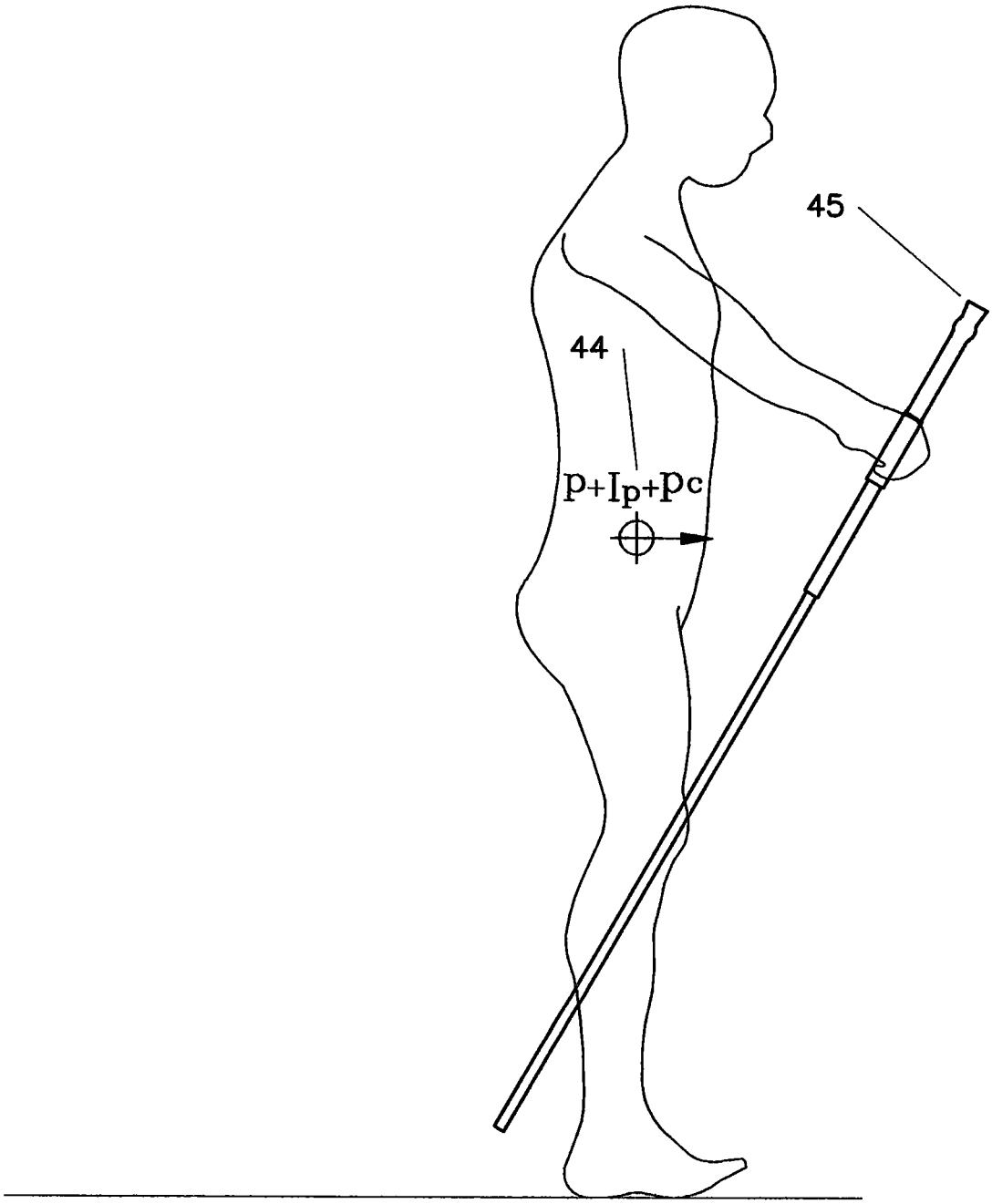

FIG. 9 depicts the person in the upright position with an increased momentum vector at the person's center of gravity, which momentum increase is equal to the sum of the vectors p, the person's walking momentum, plus the Impetus Pole impulse Ip, plus the combined masses of the Coupler and grasped hand momentum vector pc, as depicted at 44. The Impetus Pole at 45 has been lifted off the ground, and the person is ready to begin againthe method of use sequences depicted on FIG. 4, FIG. 5, FIG. 6, FIG. 7, FIG. 8, and FIG. 9.

DESCRIPTION OF THE INVENTION

The Impetus Pole stands at a chest-high length. The Stick and Pin are strong hardwood material. Surface friction forces from the stretched Elastic Tube over the Pin as well as over the Coupler are such that the Elastic Tube does not slip off of either the Pin or Coupler during use. The Elastic Tube is latex rubber with a modulus of elongation of 120 psi at 100% elongation. The Coupler is a section of steel pipe that equals the mass of the grasped hand. The lengths of the Elastic Tube and Coupler are similar. The Grip is a non-slip tape material similarly used on sporting implements such as tennis rackets and hockey sticks.

In consideration of the background and description outlined herein of the presented invention, the following claims define the scope of the protection of the patent being applied for:

The invention claimed is:

1. A walking pole comprising:

a stick having upper and lower ends;

a pin disposed at the upper end of the stick;

a cylindrical coupler disposed about the stick and configured to freely translate along the length of the stick;

a cylindrical elastic tube affixed at one end to the pin and disposed about the stick and an upper portion of the coupler; and a grip disposed about the coupler and the elastic tube; wherein:

the coupler is free to translate along the stick and the elastic tube elongates and recoils along the stick to impart impulse and momentum vectors upon the user to propel the user forward with an increase in forward momentum.

* * * * *